US011391115B2

(12) United States Patent
Parameshwaraiah et al.

(10) Patent No.: US 11,391,115 B2
(45) Date of Patent: Jul. 19, 2022

(54) PLUG PISTON BARRIER

(71) Applicant: Halliburton Energy Services, Inc., Houston, TX (US)

(72) Inventors: Rajesh Parameshwaraiah, Houston, TX (US); Min Mark Yuan, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 411 days.

(21) Appl. No.: 16/486,919

(22) PCT Filed: Aug. 1, 2019

(86) PCT No.: PCT/US2019/044694

§ 371 (c)(1),
(2) Date: Aug. 19, 2019

(87) PCT Pub. No.: WO2021/021211

PCT Pub. Date: Feb. 4, 2021

(65) Prior Publication Data

US 2021/0404286 A1 Dec. 30, 2021

(51) Int. Cl.
*E21B 33/13* (2006.01)

(52) U.S. Cl.
CPC ..... *E21B 33/13* (2013.01); *E21B 2200/08* (2020.05)

(58) Field of Classification Search
CPC .... E21B 33/13; E21B 2200/08; E21B 33/134; E21B 33/136; E21B 33/138; E21B 33/12
See application file for complete search history.

(56) References Cited

U.S. PATENT DOCUMENTS 5,765,641 A 6/1998 Shy et al.
6,026,903 A 2/2000 Shy et al.
6,076,600 A * 6/2000 Vick, Jr. ..... E21B 33/1208 166/192
6,161,622 A * 12/2000 Robb ..... E21B 23/00 166/292
9,441,446 B2 * 9/2016 Fripp ..... E21B 29/02
2008/0073075 A1 5/2008 Buyers et al.
(Continued)

FOREIGN PATENT DOCUMENTS

EP 0681097 A2 5/1995

OTHER PUBLICATIONS

Foreign Communication from Related Application—International Preliminary Report on Patentability, International Application No. PCT/US2019/044694, dated Feb. 1, 2022, 5 pages.

*Primary Examiner* — Caroline N Butcher
(74) *Attorney, Agent, or Firm* — Conley Rose, P.C.; Rodney B. Carroll

(57) ABSTRACT

A plug assembly for use in oil and gas wells includes a sleeve having a debris barrier. The plug assembly may have a top sub, a bottom sub, and a middle sub arranged between the top sub and the bottom sub. The middle sub has an interior bore, a valve and a fluid flow channel such that the valve, when opened, allows fluid to flow from an interior bore of the middle sub into the fluid flow channel. The sleeve having the debris barrier is disposed on the middle sub. Fluid flowing in the fluid flow channel moves the sleeve, which moves the debris barrier so that the debris barrier is withdrawn from the fluid flow path through the interior bores of the top sub and the middle sub.

21 Claims, 4 Drawing Sheets

(56) References Cited

U.S. PATENT DOCUMENTS

| | | | | |
|---|---|---|---|---|
| 2011/0042099 | A1* | 2/2011 | Williamson, Jr. ..... | E21B 29/02 166/373 |
| 2014/0008085 | A1* | 1/2014 | Tinnen ..... | E21B 29/00 166/387 |
| 2014/0174757 | A1 | 6/2014 | Fripp et al. | |
| 2014/0216756 | A1 | 8/2014 | Getzlaf et al. | |
| 2017/0022783 | A1* | 1/2017 | Yong ..... | H04L 41/0266 |

* cited by examiner

PLUG PISTON BARRIER

TECHNICAL FIELD

The exemplary embodiments disclosed herein relate generally to downhole tools for oil and gas wells, and, more specifically to a plug assembly that temporarily blocks fluid flow through the plug assembly and creates an air pocket between the tool and casing string.

BACKGROUND

During running casing in a horizontal well, it is desirable to float the casing to avoid drag between the casing and the wellbore by keeping a temporary air pocket between the tool and the joints of casing. Various temporary plugs have been developed for this purpose. One type of temporary plug includes a water column provided in the bore of a tubular member that is adjacent to and uphole of a plug of compressed salt. The compressed salt plug prevents the water column from flowing through the tubular string. An elastomer barrier is provided to separate the water column from the drilling fluid in the casing string uphole of the water column to avoid contaminating the water with drilling fluid.

When an operator desires to reestablish fluid flow through the casing string, fluid pressure is increased in the casing string until rupture discs in the plug assembly give way. The water then flows through channels in the plug assembly, which allows drilling fluid to rupture, or fragment, the elastomer barrier. The water then dissolves the salt plug, which then allows fluid to begin flowing through the casing string.

Although such salt plug assemblies are adequate to temporarily prevent flow of fluids through the casing string, pieces of the fragmented elastomeric barrier may clog or damage valves or other equipment located downhole in the wellbore. Therefore, there is a need for continuous improvements in the field of temporary plugs for use in the casing of oil and gas wells.

BRIEF DESCRIPTION OF THE DRAWINGS

For a more complete understanding of the exemplary disclosed embodiments, and for further advantages thereof, reference is now made to the following description taken in conjunction with the accompanying drawings in which.

DESCRIPTION OF EXEMPLARY EMBODIMENTS

The following discussion is presented to enable a person ordinarily skilled in the art to synthesize and use the exemplary disclosed embodiments. Various modifications will be readily apparent to those skilled in the art, and the general principles described herein may be applied to embodiments and applications other than those detailed below without departing from the spirit and scope of the disclosed embodiments as defined herein. Accordingly, the disclosed embodiments are not intended to be limited to the particular embodiments shown, but are to be accorded the widest scope consistent with the principles and features disclosed herein.

As mentioned above, the embodiments disclosed herein generally relate to a plug assembly for temporarily blocking the flow of fluids through the plug assembly and creating an air pocket within the casing string in an oil and gas well. This helps to float the casing while running in a horizontal well. The plug assembly may include an elastomer membrane that can be ruptured to permit fluid flow through an interior flowbore (i.e., fluid flow path) of the plug assembly when desired by an operator. The elastomer membrane may be attached or bonded to a sleeve adjacent to the middle sub that is pushed uphole when fluid flow through the interior flowbore is permitted (i.e., when the membrane is ruptured). As the sleeve moves uphole, portions of the ruptured membrane are dragged along with the sleeve, thereby removing the ruptured membrane out of the fluid flow path of the plug assembly. This prevents the ruptured membrane from being eroded and inadvertently forced downhole where membrane debris may clog or damage valves or other equipment in the well.

Figure 1:
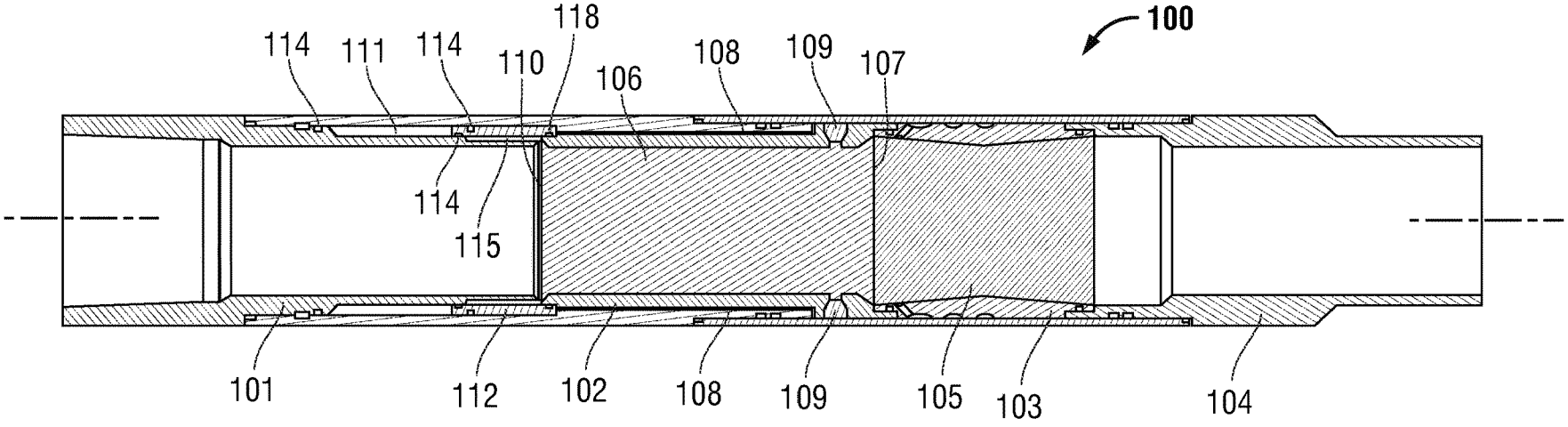
FIG. 1 is a cross-sectional view of a plug assembly in the run-in position according to embodiments of the disclosure.

FIG. 1 is a partial cross-sectional view showing a plug assembly 100 according to an embodiment of the disclosure. The plug assembly 100 includes a top sub 101 coupled to a middle sub 102 which is coupled to a housing 103. The housing 103 is, in turn, coupled to a bottom sub 104. Each of the top, middle, and bottom subs, as discussed herein, should be understood as constituted of a generally tubular member with an interior bore through which fluid may flow as part of an overall downhole tubular string.

A plug 105 is positioned in housing 103 adjacent to and coaxial with bottom sub 104. The plug 105 is typically made of salt, but any substance that easily dissolves in the presence of water or other fluids may be used for the plug 105. A column of water 106, referred to sometimes as a water piston, is present within the interior bore of middle sub 102 adjacent to salt plug 105. The combination of the water piston 106 and salt plug 105 blocks fluid flow through the flowbore of the plug assembly 100.

A thin membrane 107 separates the water piston 106 from the salt plug 105 to prevent premature dissolving of the salt plug. After the salt plug 105 dissolves, membrane 107 fragments into small pieces. Due to the thinness of membrane 107, the small pieces of membrane are able to pass through valves downhole and flush out to the surface with the drilling fluid.

A debris barrier 110, which may be an elastomer membrane, is positioned adjacent to and coaxially with the middle sub 102 such that drilling fluid in the interior bore of the top sub 101 is on one side of the barrier 110 while water in water piston 106 is on the other side of the barrier 110. The elastomer membrane debris barrier 110 thus separates the drilling fluid from the water in water piston 106 and prevents the drilling fluid from contacting the water piston 106 prior to the time that an operator desires to establish fluid flow through the plug assembly 100. This arrangement of components is referred to as the "run-in" configuration of the plug assembly 100 and reflects the state of the components as the assembly 100 is lowered into the wellbore of an oil and gas well.

Figure 2:
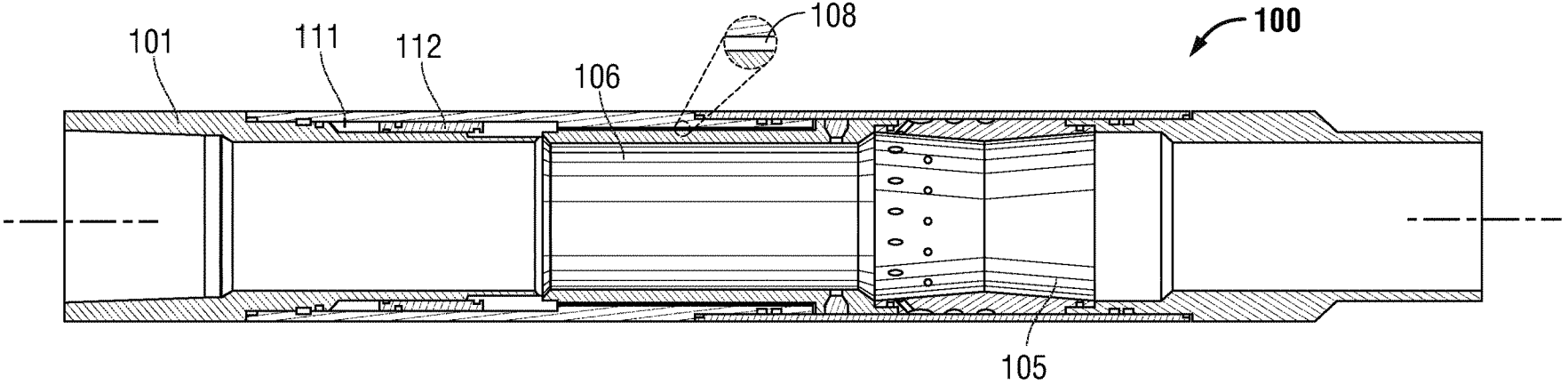
FIG. 2 is a cross-sectional view of a plug assembly during fluid flow according to embodiments of the disclosure.

The middle sub 102 is also provided with at least one water channel 108 (i.e., fluid channel) extending along a length of middle sub 102 in a housing thereof. One or more rupture discs 109 prevent water in water piston 106 from entering into one end of water channel 108. The opposite end of water channel 108 is in fluid communication with a chamber 111 formed between top sub 101 and middle sub 102, as shown in FIG. 2. That end of water channel 108 is normally blocked by a sleeve 112 (specifically, a downhole face thereof) circumferentially disposed on the top sub 101 during run-in of the plug assembly 100, as shown in FIG. 1.

During run-in of the plug assembly 100, and prior to the time the operator desires to establish fluid flow through the plug assembly 100, the water in water piston 106 is prevented from flowing into water channel 108 by rupture disc 109 and also O-ring 118 in sleeve 112. Rupture disc 109 may be any type of rupture disc known to those of skill in the art that are designed to rupture, thus allowing fluid flow, when fluid pressure in the flowbore of plug assembly 100 reaches a threshold rupture value. The rupture disc 109 thus serves as a valve in this embodiment. Other suitable valves may be used in different embodiments. The rupture pressure of rupture disc 109 is a matter of design choice and may depend on the particular characteristics of an oil and gas well.

As mentioned above, chamber 111 is formed between top sub 101 and middle sub 102 where the two subs overlap one another. Sleeve 112, which may be a metal sleeve, is positioned within chamber 111 between top sub 101 and middle sub 102. Sealing rings 114 and 118, which may be O-rings, are provided on sleeve 112 between top sub 101 and middle sub 102 to ensure there is no premature leakage of either water from water piston 106 or drilling fluids at sleeve 112 or into the chamber 111 and water channel 108.

In operation, the plug assembly 100 is run into the wellbore of the oil and gas well with bottom sub 104 being arranged on the tool so that it is downhole of top sub 101. In this run-in position, depicted in FIG. 1, the water piston 106 and salt plug 105 serve to block any flow of drilling fluid through top sub 101 and into bottom sub 104.

When fluid flow through plug assembly 100, and thus through the casing string in the wellbore, is desired, pressure in the drilling fluid in the casing string is increased. The pressure increase in the drilling fluid is transmitted through elastomer membrane 110 and into water piston 106. The water in water piston 106 further transmits the increased pressure to rupture disc 109. When the hydraulic pressure in the well reaches the burst point of rupture disc 109, the disc bursts, allowing water from water piston 106 to escape past the now-ruptured disc. The water then moves through gaps and interstices (not expressly labeled) between middle sub 102 and an outer housing thereof and enters water channel 108 (also called "gun drill"). As the water works into channel 108, the pressure of the drilling fluid in top sub 101 causes elastomer membrane 110 to stretch until it exceeds its structural integrity limit and fails, typically fragmenting into a petal-shaped pattern. The drilling fluid in top sub 101, having displaced the water in water piston 106, then contacts the salt plug 105, dissolving it, thereby allowing fluid flow through the casing string.

The water coming in under pressure into water channel 108 presses against the downhole face of sleeve 112. The pressurized water in water channel 108 pushes sleeve 112 in the uphole direction along an outer surface of top sub 101 into chamber 111. The pressure from the water in water channel 108 is just sufficient to unseal the O-rings 114 and 118 on sleeve 112 and allow the sleeve to move into chamber 111. Once the O-rings unseal, drilling fluid pushes the sleeve 112 further into chamber 111, dragging along the now-fragmented elastomer membrane 110 attached thereto.

In some embodiments, the fragmented elastomer membrane 110 may be dragged by sleeve 112 into a pocket area 115 where it may be held out of the fluid flow path. In these embodiments, the downhole portion of top sub 101 may be reduced in wall thickness relative the uphole portion (e.g., by about 0.5 to 1.0 inch) to create the pocket area 115 between sleeve 112 and a downhole end of top sub 101 where the two overlap. The pocket area 115 provides a place to temporarily store the fragmented elastomer membrane 110, preventing pieces thereof from being carried downhole.

FIG. 2 shows a cross-sectional view of the plug assembly 100 from FIG. 1 after fluid flow through the casing has been established. In this view, salt plug 105 has been dissolved by fluid flow through the flowbore of the plug assembly 100, allowing drilling fluids to flow through the casing string. Pressure from the water now in water channel 108 (which water was previously in water piston 106) has forced sleeve 112 along top sub 101 in the uphole direction into chamber 111.

Because the elastomer membrane 110 was bonded or otherwise attached to sleeve 112 when the sleeve moved into chamber 111, the (fragmented) membrane 110 was dragged along therewith and deposited in pocket area 115. The pocket area 115 provides cover for the fragmented elastomer membrane 110 between the sleeve 112 and the top sub 101, keeping the membrane out of the flow path of the fluids flowing through plug assembly 100. This helps prevent pieces of the fragmented elastomer barrier 10 from being carried away by the fluid flow through the downhole casing where they might otherwise clog the float collar valve (not shown) of the cementing tool or interfere with the operation of other downhole valves or equipment.

Figure 3:
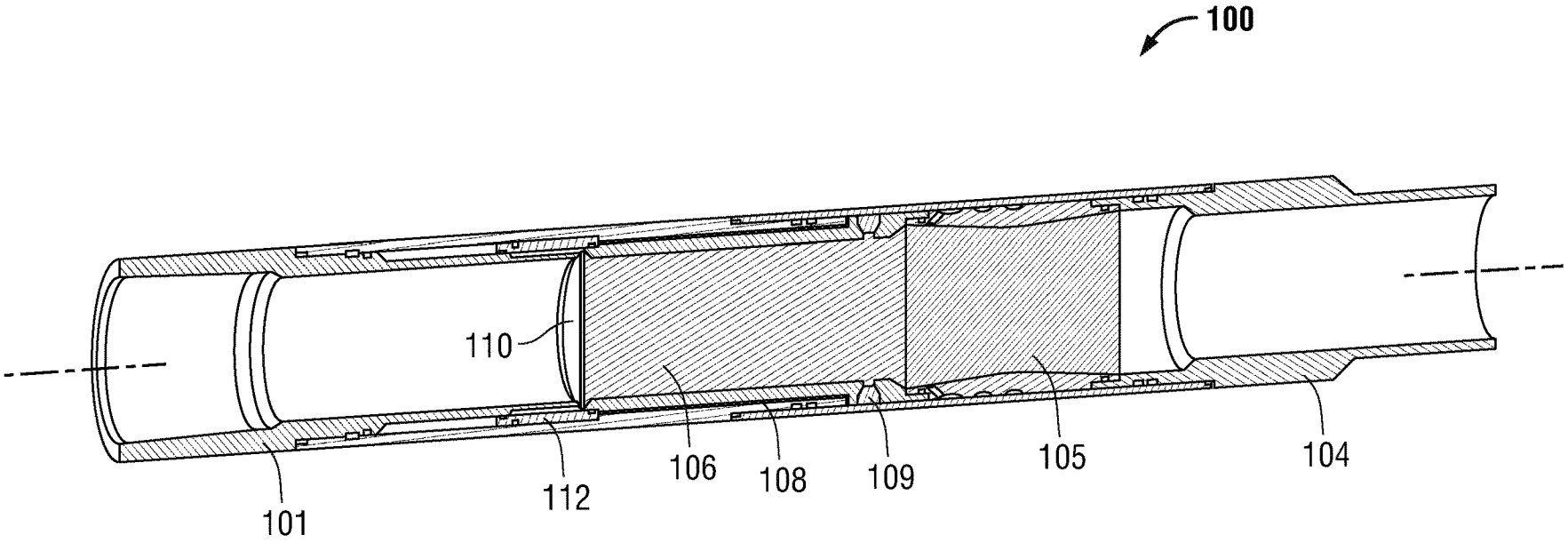
FIG. 3 is a cutaway view of a plug assembly in the run-in position according to embodiments of the disclosure.

FIG. 3 shows a partial cutaway view of plug assembly 100 in the run-in position according to an embodiment of the disclosure. The figure again shows top sub 101, bottom sub 104, and middle sub 102. It will be appreciated, however, that the disclosed embodiments are not limited to the use of specific subs, but any arrangement of tubular members may be used within a downhole tool provided the mechanism described herein operates to allow a sleeve to slide along a tubular member to withdraw a fragmented elastomer membrane from the fluid flow path through the tool. For example, sleeve 112 could be provided on a tubular member, such as a housing, that is arranged inside the top sub 101 or other tubular member in the string. Therefore, there could be any number of tubular members located between top sub 101 and bottom sub 104 so long as the sleeve is allowed to move and withdraw the fragmented membrane from the flow path.

Further, although sleeve 112 is depicted in FIG. 3 as a cylindrical sleeve, it will be appreciated that other arrangements, such as a ring provided with fingers for holding the elastomer membrane 110, are possible. It will also be appreciated that the rupture disc 109 only illustrates one particular embodiment, and other valves may be employed to allow fluid to flow into fluid channel 108 to move the sleeve 112.

Figure 4A:
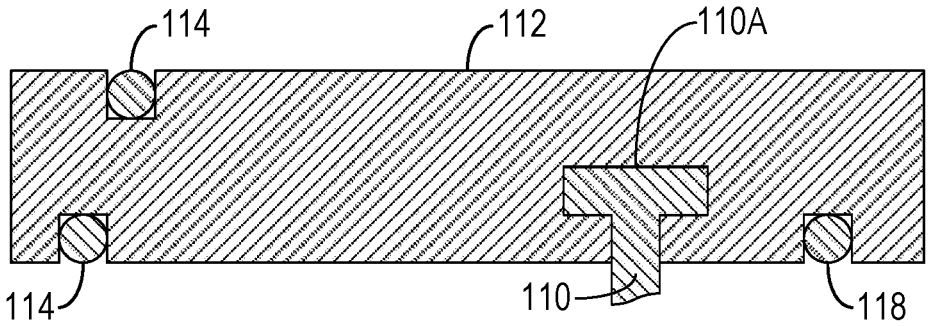
FIGS. 4A-4B are cross-sectional views of a sleeve for a plug assembly according to embodiments of the disclosure.
Figure 4B:
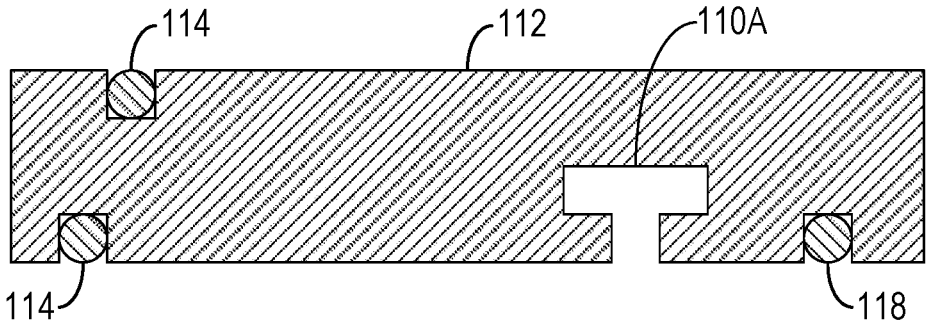

FIG. 4A is a cross-sectional view of an exemplary embodiment of sleeve 112 illustrating how the elastomer membrane 110 may be bonded or otherwise attached to sleeve 112. As can be seen, sleeve 112 is provided with O-rings 114 that help provide a seal between top sub 101 and middle sub 102 (see FIG. 1) and O-ring 118 that helps provide a seal between the sleeve and water channel 108. Membrane 110 is bonded or otherwise attached to sleeve 112 via a T-shaped slot 110A formed in the sleeve. The T-shaped slot 110A can be seen in FIG. 4B with membrane 110 removed for clarity. Other slot shapes and/or other attachment techniques, including chemical and mechanical techniques (e.g., adhesive, fasteners, etc.), may certainly be used within the scope of the present disclosure.

Figure 5:
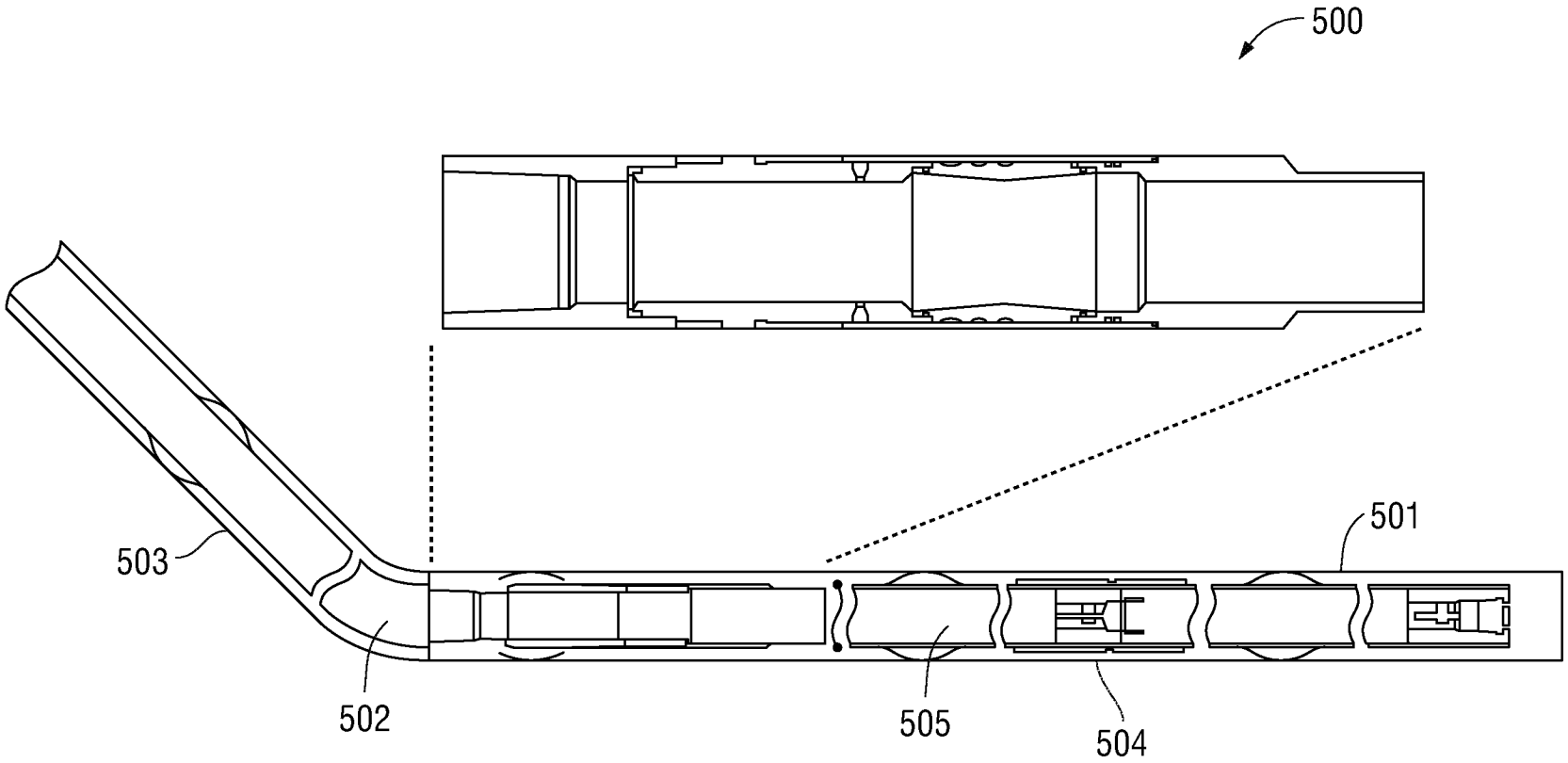
FIG. 5 is a schematic diagram of a plug assembly arranged in a horizontal casing string according to embodiments of the disclosure.

FIG. 5 shows a plug assembly 500 according to embodiments of the present disclosure similar to the plug assembly 100 of FIG. 1, but arranged in a horizontal section of casing as it would be used in a drilling operation. In this embodiment, the plug assembly 500 is arranged within a larger section of casing string 501. The upper section 503 of the casing string is filled with drilling fluid 502. The drilling fluid is prevented from entering the lower section 504 of the casing string by the plug assembly 500. Below the plug assembly 500 is chamber SOS. There may also be additional equipment, such as a float shoe and collar, valves, and other equipment (not shown) in the lower section of the casing string 504. Portions of the lower section 504 of casing string 501 may also be filled with light weight fluid, such as a fluid lighter than drilling mud 502. The result is that the lower section 504 of the casing string is buoyant in the wellbore, which reduces the drag between the casing and the formation. This increases the possible running depth of the casing, and minimizes the chances of the casing buckling or sticking.

As the foregoing demonstrates, the embodiments disclosed herein may be implemented in a number of ways. For example, in one aspect, embodiments of the present disclosure relate to a plug assembly for temporarily blocking fluid flow in a casing string of an oil and gas well. The plug assembly comprises, among other things, a top sub having an interior bore, a bottom sub disposed downhole of the top sub and having an interior bore, and a middle sub coupled to the top sub and the bottom sub therebetween. The middle sub has an interior bore, a fluid channel extending along a length of the middle sub, and a valve that, when opened, allows fluid to flow from the interior bore of the middle sub into the fluid channel. The plug assembly further comprises a sleeve mounted coaxially between the top sub and the middle sub adjacent to the fluid channel, the sleeve having a debris barrier attached thereto and positioned adjacent to the middle sub, the debris barrier separating the interior bore of the middle sub from the interior bore of the top sub. The sleeve is configured to move uphole along the top sub in response to fluid pressure in the fluid channel such that the debris barrier is withdrawn from a fluid flow path through the interior bores of the top sub and the middle sub.

In accordance with any one or more of the foregoing embodiments, the valve is opened in response to fluid pressure in the interior bore of the middle sub, the valve comprises a rupture disc, and/or the debris barrier comprises an elastomer membrane.

In accordance with any one or more of the foregoing embodiments, the plug assembly further comprises a dissolvable plug adjacent to and coaxial with the middle sub, the dissolvable plug preventing fluid flow through the plug assembly to thereby maintain an air pocket between the plug assembly and the casing string.

In accordance with any one or more of the foregoing embodiments, the dissolvable plug comprises compressed salt, the sleeve and the top sub define a pocket area between the sleeve and a downhole end of the top sub and the debris barrier is withdrawn into the pocket area when the sleeve moves uphole along the top sub, and/or the sleeve moves by sliding along a portion of the top sub in response to fluid pressure in the fluid channel.

In general, in another aspect, embodiments of the present disclosure relate to an apparatus for temporarily preventing fluid flow through a casing string in an oil and gas well. The apparatus comprises, among other things, a first tubular member, and a second tubular member coupled to the tubular member and having a valve that, when opened, permits fluid flow from an interior of the second tubular member into a fluid channel of the second tubular member. The apparatus further comprises a sleeve arranged coaxially between the first tubular member and the second tubular member adjacent to the fluid channel, the sleeve configured to slide over an outer surface of the first tubular member in response to fluid pressure in the fluid channel, the sleeve having an elastomer member attached thereto that serves to separate an interior of the first tubular member from the interior of the second tubular member.

In accordance with any one or more of the foregoing embodiments, the valve is opened in response to fluid pressure in the interior of the second tubular member, and/or the valve comprises a rupture disc.

In accordance with any one or more of the foregoing embodiments, the sleeve and the first tubular member define a pocket area therebetween and the elastomer member is dragged into the pocket area when the sleeve slides over the outer surface of the first tubular member, and/or the first and second tubular members define a chamber therebetween to receive the sleeve when the sleeve slides over the outer surface of the first tubular member in response to fluid pressure in the fluid channel.

In accordance with any one or more of the foregoing embodiments, the apparatus further comprises a removable plug adjacent to and coaxial with the second tubular member, and the removable plug comprises compressed salt that can be dissolved by fluid in the interior of the first and second tubular members.

In general, in yet another aspect, embodiments of the present disclosure relates to a method of temporarily plugging fluid flow through a tubular string of an oil and gas well. The method comprises, among other things, providing a first tubular member, and coupling a second tubular member to the first tubular member, the second tubular member having a valve that, when opened, permits fluid flow from an interior of the second tubular member into a fluid channel of the second tubular member. The method further comprises mounting a sleeve between the first tubular member and the second tubular member, the sleeve configured to slide over an outer surface of the first tubular member in response to fluid pressure in the fluid channel, the sleeve having an elastomer member attached thereto that serves to separate the interior of the first tubular member from the interior of the second tubular member.

In accordance with any one or more of the foregoing embodiments, the method further comprises opening the valve by increasing hydraulic pressure in the interior of the first and second tubular members, and/or sliding the sleeve over the outer surface of the first tubular member using fluid pressure in the fluid channel In accordance with any one or more of the foregoing embodiments, the valve is a rupture disc and opening the valve comprises rupturing the rupture disc, and/or the elastomer member is withdrawn from a fluid flow path through the interiors of the first and second members when the sleeve slides along the first tubular member.

Further, although reference has been made to uphole and downhole directions, it will be appreciated that this refers to the run-in direction of the tool, and that the tool is useful in horizontal casing run applications, and the use of the terms of uphole and downhole are not intended to be limiting as to the position of the plug assembly within the downhole formation.

While the invention has been described with reference to one or more particular embodiments, those skilled in the art will recognize that many changes may be made thereto without departing from the spirit and scope of the description. Each of these embodiments and obvious variations thereof is contemplated as falling within the spirit and scope of the claimed invention, which is set forth in the following claims.

What is claimed is:

1. A plug assembly for temporarily blocking fluid flow in a casing string of an oil and gas well, comprising:

a top sub having an interior bore;

a bottom sub disposed downhole of the top sub and having an interior bore; a middle sub coupled to the top sub and the bottom sub there between, the middle sub having an interior bore, a fluid channel extending along a length of the middle sub, and a valve that, when opened, allows fluid to flow from the interior bore of the middle sub into the fluid channel; and a sleeve mounted coaxially between the top sub and the middle sub adjacent to the fluid channel, the sleeve having a debris barrier attached thereto and positioned adjacent to the middle sub, the debris barrier separating the interior bore of the middle sub from the interior bore of the top sub;

wherein the sleeve is configured to move uphole along the top sub in response to fluid pressure in the fluid channel such that the debris barrier is withdrawn from a fluid flow path through the interior bores of the top sub and the middle sub and wherein the sleeve and the top sub define a pocket area between the sleeve and a downhole end of the top sub and the debris barrier is withdrawn into the pocket area when the sleeve moves uphole along the top sub.

2. The plug assembly of claim 1, wherein the valve is opened in response to fluid pressure in the interior bore of the middle sub.

3. The plug assembly of claim 1, wherein the valve comprises a rupture disc.

4. The plug assembly of claim 1, wherein the debris barrier comprises an elastomer membrane.

5. The plug assembly of claim 1, further comprising a dissolvable plug adjacent to and coaxial with the middle sub, the dissolvable plug preventing fluid flow through the plug assembly to thereby maintain an air pocket between the plug assembly and the casing string.

6. The plug assembly of claim 5, wherein the dissolvable plug comprises compressed salt.

7. The plug assembly of claim 1, wherein the sleeve moves by sliding along a portion of the top sub in response to fluid pressure in the fluid channel.

8. An apparatus for temporarily preventing fluid flow through a casing string in an oil and gas well, the apparatus comprising:

a first tubular member;

a second tubular member coupled to the first tubular member and having a valve that, when opened, permits fluid flow from an interior of the second tubular member into a fluid channel of the second tubular member; and a sleeve arranged coaxially between the first tubular member and the second tubular member adjacent to the fluid channel, the sleeve configured to slide over an outer surface of the first tubular member in response to fluid pressure in the fluid channel, the sleeve having an elastomer member attached thereto that serves to separate an interior of the first tubular member from the interior of the second tubular member.

9. The apparatus of claim 8, wherein the valve is opened in response to fluid pressure in the interior of the second tubular member.

10. The apparatus of claim 8, wherein the valve comprises a rupture disc.

11. The apparatus of claim 8, wherein the sleeve and the first tubular member define a pocket area there between and the elastomer member is dragged into the pocket area when the sleeve slides over the outer surface of the first tubular member.

12. The apparatus of claim 8, further comprising a removable plug adjacent to and coaxial with the second tubular member.

13. The apparatus of claim 12, wherein the removable plug comprises compressed salt that can be dissolved by fluid in the interior of the first and second tubular members.

14. The apparatus of claim 9, wherein the first and second tubular members define a chamber there between to receive the sleeve when the sleeve slides over the outer surface of the first tubular member in response to fluid pressure in the fluid channel.

15. A method of temporarily plugging fluid flow through a tubular string of an oil and gas well, the method comprising:

providing a first tubular member;

coupling a second tubular member to the first tubular member, the second tubular member having a valve that, when opened, permits fluid flow from an interior of the second tubular member into a fluid channel of the second tubular member; and mounting a sleeve between the first tubular member and the second tubular member, the sleeve configured to slide over an outer surface of the first tubular member in response to fluid pressure in the fluid channel, the sleeve having an elastomer member attached thereto that serves to separate the interior of the first tubular member from the interior of the second tubular member.

16. The method of claim 15, further comprising opening the valve by increasing hydraulic pressure in the interior of the first and second tubular members.

17. The method of claim 16, wherein the valve is a rupture disc and opening the valve comprises rupturing the rupture disc.

18. The method of claim 15, further comprising sliding the sleeve over the outer surface of the first tubular member using fluid pressure in the fluid channel.

19. The method of claim 15, wherein the elastomer member is withdrawn from a fluid flow path through the interiors of the first and second members when the sleeve slides along the first tubular member.

20. A plug assembly for temporarily blocking fluid flow in a casing string of an oil and gas well, comprising:

a top sub having an interior bore;

a bottom sub disposed downhole of the top sub and having an interior bore; a middle sub coupled to the top sub and the bottom sub there between, the middle sub having an interior bore, a fluid channel extending along a length of the middle sub, and a valve that, when opened, allows fluid to flow from the interior bore of the middle sub into the fluid channel; and a sleeve mounted coaxially between the top sub and the middle sub adjacent to the fluid channel, the sleeve having a debris barrier attached thereto and positioned adjacent to the middle sub, the debris barrier separating the interior bore of the middle sub from the interior bore of the top sub;

wherein the sleeve is configured to move uphole along the top sub in response to fluid pressure in the fluid channel such that the debris barrier is withdrawn from a fluid flow path through the interior bores of the top sub and the middle sub, and further comprising a dissolvable plug adjacent to and coaxial with the middle sub, the dissolvable plug preventing fluid flow through the plug assembly to thereby maintain an air pocket between the plug assembly and the casing string.

21. The plug assembly of claim 20, wherein the dissolvable plug comprises compressed salt.

* * * * *